US006598557B2

(12) United States Patent
Kelley

(10) Patent No.: US 6,598,557 B2
(45) Date of Patent: Jul. 29, 2003

(54) SIMULTANEOUS TOASTING DEVICE

(76) Inventor: Peter H. Kelley, 100 Mount St. Berlin, Barre, VT (US) 05641

( * ) Notice: Subject to any disclaimer, the term of this patent is extended or adjusted under 35 U.S.C. 154(b) by 0 days.

(21) Appl. No.: 09/923,128

(22) Filed: Aug. 6, 2001

(65) Prior Publication Data

US 2003/0024464 A1 Feb. 6, 2003

(51) Int. Cl.[7] ..... G10K 1/32
(52) U.S. Cl. ..... 116/169; 84/402; 84/403
(58) Field of Search ..... 116/169, 148, 116/150, 152; 84/402, 403, 410; 446/418, 419, 421, 422

(56) References Cited

U.S. PATENT DOCUMENTS

| | | | | | |
|---|---|---|---|---|---|
| 437,744 | A | * | 10/1890 | Zeller | 84/402 |
| 706,230 | A | * | 8/1902 | Fuller | 84/402 |
| 1,100,671 | A | * | 6/1914 | Deagan | 84/403 |
| 1,752,529 | A | * | 4/1930 | Kitching | 84/402 |
| 4,111,094 | A | * | 9/1978 | Broser | 84/402 |
| 4,237,767 | A | * | 12/1980 | Levine | 84/406 |
| D258,809 | S | * | 4/1981 | Halburian | D10/116 |
| 4,807,510 | A | * | 2/1989 | Croteau | 84/402 |
| 6,166,310 | A | * | 12/2000 | Carter | 84/402 |

* cited by examiner

*Primary Examiner*—Diego Gutierrez
*Assistant Examiner*—Tania C. Courson

(57) ABSTRACT

A simultaneous toasting device comprising a pair of vertical support members each having an arm extending therefrom, the arms further extending towards one another, the arms each having a filament depending therefrom, and a sounding element, the sounding element being supported by the filaments and extending between the vertical support members such that the arms each extend toward the sounding element.

12 Claims, 2 Drawing Sheets

SIMULTANEOUS TOASTING DEVICE

CROSS REFERENCE TO OTHER APPLICATIONS

This is the first submission of an application for this article of manufacture. There are no other applications, provisional or non provisional.

FEDERALLY SPONSORED RESEARCH AND DEVELOPMENT

There are no federally sponsored or funded research or development projects or undertakings in any way associated with the instant invention.

Your inventor, Peter H. Kelley, hereby respectfully submits this, his non-provisional application for Letters Patent as respects his invention entitled "Simultaneous Toasting Device".

BACKGROUND OF THE INVENTION

1. Field of the Invention

The instant invention relates to that field of devices consisting of articles of manufacture known as toasting devices. Specifically, the instant invention is a toasting device for permitting multiple people to offer and engage in a simultaneously executed toast.

2. Background Information

The prior art known to the Inventor discloses that offering and engaging in a toast amongst multiple participants has changed little if at all since toasts over drinks were first incorporated into social gatherings.

A "toast" is traditionally the common name for the offering of well wishes. In the typical toasting situation, a group of people will be gathered in reasonably close proximity, and will be desirous of bringing together various liquid refreshment containers at nearly the same time in accompaniment with the offering of a sentiment, well wishes, or nugget of wisdom directed toward someone or something.

For example, consider a group of people gathered together and seated around a large, generally rectangular table. At some point during the gathering, an individual might be desirous of wishing a "happy and healthy life" to the host, hostess, or even to all those in attendance.

Normally, the person offering the toast will rise to a standing position, and lift his or her glass upwardly as a signal that a toast is being offered (this is frequently accompanied by a tapping or rapping upon the glass with a nearby eating utensil to produce a "chiming" sound to further alert those gathered that a toast is about to be offered).

The other gatherers may at that point rise as well, or just as likely remain seated. Traditionally, the person offering the toast then addresses the group and verbally offers the words embodying that toast. At the conclusion of the oration, the participants then attempt to bring their beverage containers together simultaneously to produce a distinct and auditorially pleasant "chiming" sound. Naturally, the precise sound made by the bringing together of the beverage containers depends in large measure upon the material from which those beverage containers are made. The traditionally preferred beverage container has been the "glass" or "crystal goblet", both of which produce an enjoyable and nearly bell-like ring when lightly rapped or touched against one another at the conclusion of the toast.

It is further well known that when engaged in an inherently social event such as toasting, there are certain difficulties associated with the physical placement of the various individuals who are to participate in the toast. For example, when seated about a fairly large rectangular table (one having a width of approximately 3 feet or more and a length of approximately 6 feet or more), it has always been highly desirable to be seated in close proximity to the host, hostess or any guest of honor to whom a toast may be offered. This is due in part to the fact that at the conclusion of the offering of the toast, those most proximate to the aforementioned persons will be immediately able to bring their beverage container into direct contact with that person's. Those in close proximity to the most prominent guests enjoy a distinct social advantage of being able to "chime" their glasses directly with the prominent individual immediately at the close of the toast.

And while this may not be of great import in the most ordinary dining or social gathering circumstances, it can be of incredible importance where interpersonal relationships are first being created, business relationships are being solidified, or familial relationships are being affirmed.

It is further well known that at important social gatherings, where toasts are expected to be offered, it is usually necessary to get up out of the chair in which one has been seated prior to the offering of the toast in order to bring one's beverage container into direct contact with other "toasters" who are inconveniently located at a distance which prevents the bringing together of those beverage containers. For example, if one is seated 5 or 6 feet away from the hostess, it is simply impossible to bring one's glass into immediate contact with the hostess' glass without getting up out of one's chair, and walking over to where the hostess is seated. More often than not, other persons seated at a distance from the hostess will be arising and moving toward the hostess as well, producing a discomforting and somewhat crass "rush" toward said hostess.

A further problem associated with offering and engaging in toasting is that the highly desirable "simultaneity" of the event is typically lost when one must arise and travel about the table in order to bring one's glass into direct contact with another's. Though bearing with it no exceptional social stigma, these later in time meeting of glasses are often nowhere near as fulfilling to the participants as are the simultaneous ones.

And while it may be possible to remain seated and still reach across a table to touch glasses with those located at some distance, such a maneuver not only ruins the socially desirable simultaneity, but also brings with it the gravely embarrassing possibility of brushing one's clothing against or through food stuffs which may still occupy the table. Certainly it is important to have the opportunity to reach across the table and "ring" one's glass against that of the host, but when that opportunity entails a sizable chance of dipping one's sleeve in the gravy boat, (and spending the night trying to hide an oily stain), most will be daunted by the task and settle for simply "lifting" their glasses.

SUMMARY OF THE INVENTION

The instant invention is toasting device which may be placed upon a convenient, generally horizontal surface and permit the accomplishment of a simultaneous toast by a plurality of persons.

Unlike the more traditional method of toasting which required the participants to attempt to bring their individual glasses into contact with one another, the instant invention allows them to simultaneously touch their individual glasses to the "sounding element", and in so doing produce a delightful ringing sound through both the sounding element and their glasses.

The instant invention, for the first time, permits those gathered around a table to simultaneously engage in a toast which will produce a tone which is both pleasing to the ear, and at the same time satisfies the socially desirable need to "touch glasses".

A first object of the instant invention, therefore, is to provide for a means by which "toasters" may in effect, simultaneously touch glasses.

This objective is accomplished by fabricating a vertical support member having depending therefrom an essentially horizontally disposed sounding element against which each toaster may touch his or her glass to at the same moment, thus, by proxy, simultaneously touching one another's glass to complete the toast.

A second object of the invention is to provide a device which enables various persons who are not located directly proximate to one another to effectively simultaneously create the desired "chiming" sound with one another.

This objective is accomplished by having a sounding element of sufficient dimensions such that it is easily within reach of all the toasting participants, and which sounding element itself is engineered to produce a pleasing chiming sound when touched by the various toaster's glasses.

A third object of the invention is to provide a device which eliminates the need for certain toasters to leave their places at a table following a toast to contact their glass with the glass of other toasters.

This objective is accomplished by designing a sounding element having sufficient dimensions such that it is within easy reach of all the toast participants at the table.

A fourth object of the invention is to virtually eliminate the possibility of dragging one's sleeve through food stuffs located on a table when engaging in a toast while still sitting at the table.

This objective is accomplished through the use of a sounding element suspended from a vertical support member which locates the sounding element sufficiently above the table such that when touching one's glass to the sounding element, there is little to no chance that one's clothing will come in contact with said food stuffs.

A fifth object of the instant invention is to provide for a device to simultaneously execute a toast which may be easily stored when not in use.

This objective is accomplished by fabricating a sounding element which is removably suspended from one or more vertical support members. The vertical support members may be decoratively or even functionally designed to remain in place on a table before or after a toast, while the sounding element and its suspension means are conveniently stored away in a closet or other storage area.

A sixth object of the instant invention is to provide a device for simultaneous toasting which may be configured for different occasions to produce different tones when in use.

This objective is accomplished by incorporating a sounding element which is preferably a hollow tube, the type of material used in constructing same and thickness of the tube wall largely dictating the pitch and resonance of the sound produced when struck by a toaster's glass. By having on hand a variety of differently dimensioned and or compositioned sounding elements, the user may choose in advance the sound which is desired, according to mood or whim.

A seventh object of the instant invention is to provide for a simultaneous toasting device which is useful even when toasters are not seated around a table, for example, when attending a ball or other large attendance social event where one is frequently standing.

This objective is accomplished by fabricating one or more vertical support members having dimensions such that a sounding element suspended from said support member will be at an appropriate elevation for those standing about the device to bring their glasses into contact with the sounding element without undue upward or downward reaching.

A DESCRIPTION OF THE DRAWINGS

A DESCRIPTION OF THE PREFERRED EMBODIMENT

Figure 1:
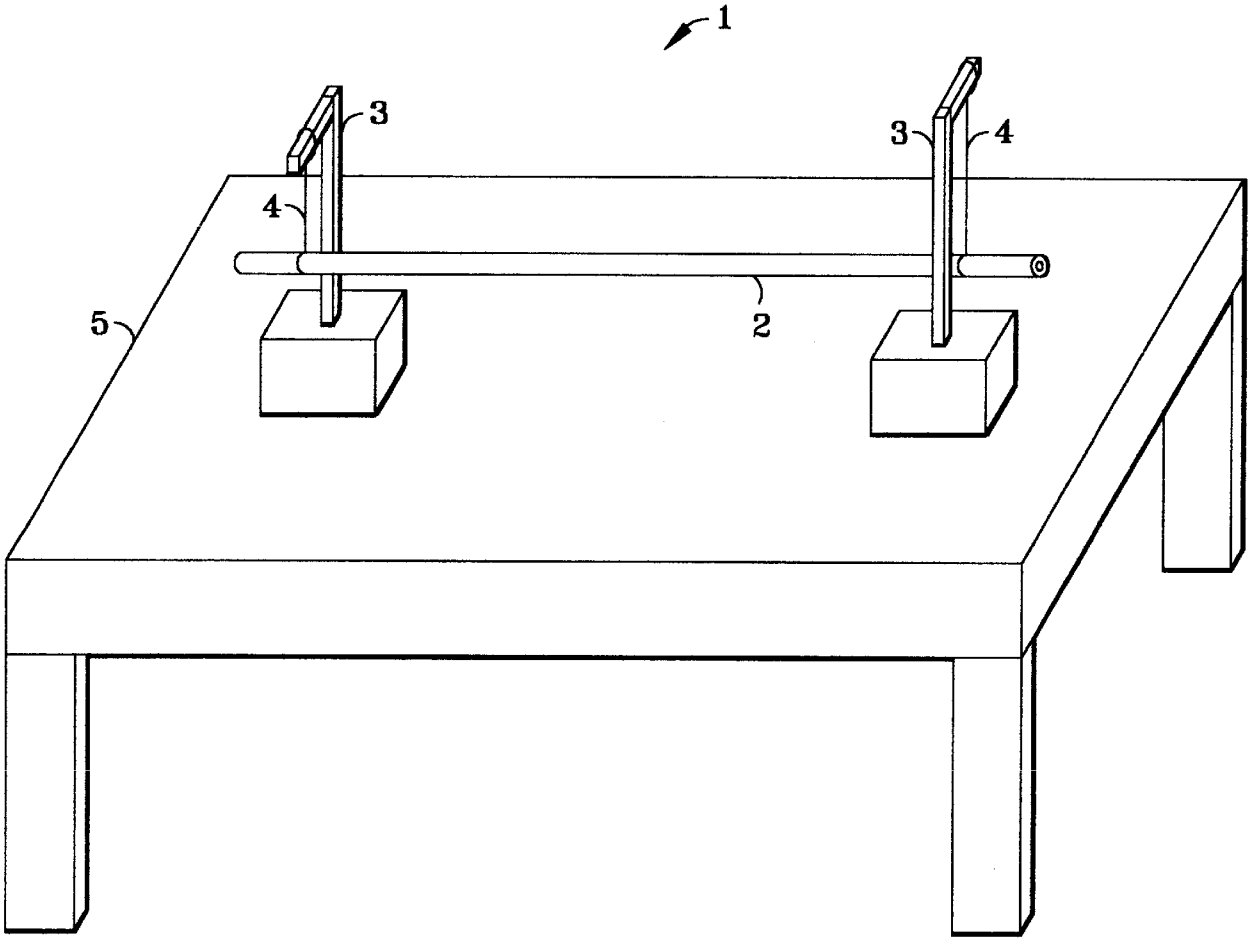
FIG. 1 is a perspective view of the instant invention in place on a dining table.
Figure 3:
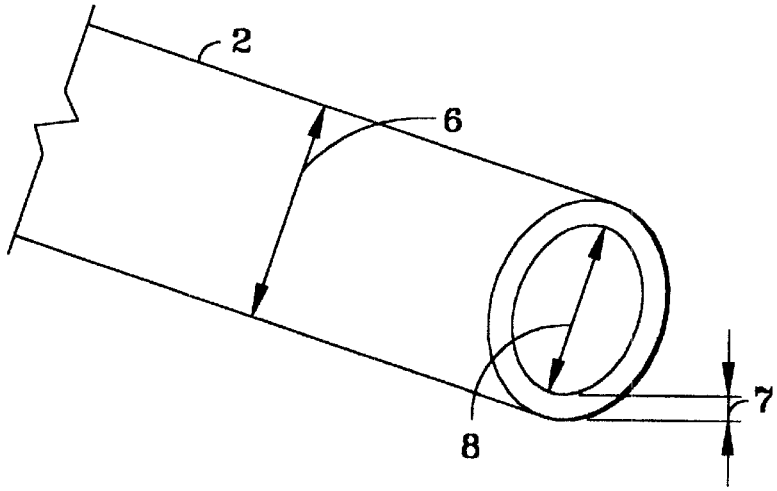
FIG. 3 is a close up perspective of a tubular sounding element.

As per FIGS. 1 and 3, a simultaneous toasting device (1) is, in the preferred embodiment, a sounding element (2) which is removably suspended from a vertical support member (3) by suspension means (4), the sounding element, the vertical support member, and the removable suspension means being dimensioned such that they may be placed on a dining table (5) and be within reach by all those seated around said table.

In the preferred embodiment, the sounding element is a hollow tube having length, exterior diameter (6), tube wall thickness (7) and hollow interior diameter (8). When struck by an object (preferably a beverage container such as a drinking glass or crystal goblet), the sounding element will produce an audible tone. It is well known that by varying any of the length, wall thickness, hollow interior diameter, or exterior diameter, the pitch of the tone produce when striking the sounding element will be modified. For example, to produce a deeper tone (lower pitch), one may keep the length and exterior diameter constant, while increasing the hollow interior diameter and therefore decreasing the wall thickness. A higher pitch may be just as easily produced by maintaining the length and exterior diameter, and decreasing the hollow interior diameter and therefore increasing the wall thickness. While the preferred embodiment utilizes a sounding element which is a hollow tube, it could just as easily be in the form of a bar having a generally rectangular or square cross section, or nearly any other geometric pattern cross section. Also, while the inventor believes that the sounding element should be hollow in the preferred embodiment, this is simply a preference, not a requirement. The tone desired when striking the sounding element will largely dictate the dimensions, material composition and cross sectional solidity or hollowness of this element of the device. Other considerations, such as ruggedness may further influence the choice of materials and dimensions. For example, if the sounding element is to be left in place in a safe location, one might well decide to fabricate the sounding element from leaded crystal in order to more faithfully reproduce the sound which is made when two crystal goblets are tapped against one another following a toast. So long as the sounding element has sufficient length so as to be within easy reach of those participating in the toast, and so long as it is sufficiently rugged so that it is not damaged or destroyed during the process of tapping beverage containers against it, the precise materials and dimensions are relatively unimportant.

In order to practice the instant invention with no experimentation whatsoever, the inventor notes that he prefers the sounding element to be fabricated from brass, the precise alloy composition being virtually irrelevant, the sounding element further being of a hollow tube construction having length of approximately 44 inches, exterior diameter (6) of approximately 0.500 of one inch, tube wall thickness (7) of 0.065 of one inch and hollow interior diameter (8) of 0.370 of one inch. Again, these measurements are provided merely for the sake of disclosing the inventor's best mode for practicing the instant invention. The material composition and measurements may be varied with no difficulty by those familiar with the art in order to produce different tonal qualities and differing properties for various situations including location of use, frequency of use, and ruggedness.

Figure 2:
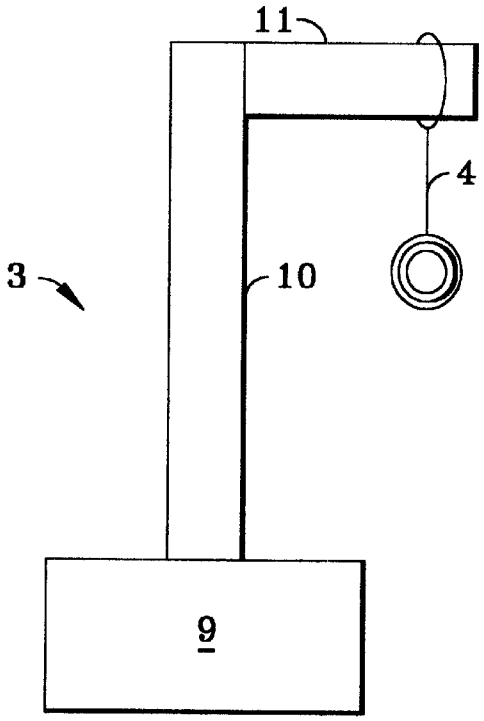
FIG. 2 is a close up perspective view of the vertical support member.

As per FIGS. 1 and 2, in the preferred embodiment the instant invention utilizes a pair of vertical support members (3). The ideal configuration for the vertical support member is a base (9), an upright section (10), and an arm (11). The base (9) serves to support the upright section and the arm. The upright section (10) preferably has a first end and an opposite second end, the first end being attached to the base. The upright section serves to elevate the sounding element (2) above the horizontal surface upon which the vertical support member is placed (for example, a dining room table). The arm (11) is attached to the upright section, preferably being located more proximate to the upright section second end than first end. The arm extends outwardly, away from the upright section, and both serves as an attachment point for the suspension means (4), as well as providing some distance between the sounding element and the upright section when fully assembled. It is preferred to have some distance between the upright section and sounding element when fully assembled so that the sounding element, after being struck during a toast, will be less likely to come into direct contact with the upright section. The inventor has learned that contact between the sounding element and upright section following a striking of the sounding device tends to spoil the tone produced by the sounding element in much the same way that touching the tines of a "pitch fork" once it is vibrating will tend to diminish if not completely terminate the vibrations which are producing sound.

As per FIGS. 1 and 2, the inventor has discovered that in order for the device to function optimally, it is preferable for the vertical support member to be stable when the device is completely assembled and in place on the horizontal surface such as the table (5). The inventor has discovered two primary means by which he prefers to use to ensure stability of the simultaneous toasting device. First, it is believed that when using at least two vertical support members to suspend the sounding element (2) above the horizontal surface such as a table (5), those two vertical support members should be oriented such that the arms (11) extend outwardly in opposite directions. That is, if the arm of one vertical support member extends from its point of attachment to the upright section (10) outwardly, in an easterly direction, then the other vertical support member should be oriented such that the arm of that vertical support member extends from its point of attachment to its upright section, outwardly, in a westerly direction. The arms then would essentially extend toward one another, and toward the sounding element extending between them.

This manner of arranging a pair of vertical support members has been found advantageous in that the simultaneous toasting device is far less likely to tip over than it would be if the vertical support members were arranged such that the base of each were on the same side of the sounding element with the arm extending outwardly in the same direction.

The second means by which the inventor further ensures the stability of the simultaneous toasting device when fully assembled is by varying the dimensions and material composition of the vertical support member itself. For example, a first exemplar sounding element which is 4 feet long, composed of brass and has a tube wall thickness of ½ of one inch and an exterior diameter of 1 and ½ inches will have a greater weight (mass) than a second exemplar sounding element which is 4 feet long, composed of the same material, and has a tube wall thickness of only ¼ of one inch and an exterior diameter of 1 and ½ inches. The vertical support members used to suspend the second exemplar sounding element will be required to carry less weight without tipping over than would the vertical support members used to suspend the first exemplar sounding element.

The inventor has discovered that achieving stability of the vertical support members may be easily achieved by modifying the distance between the sounding element (2) and the upright section (10), and/or modifying the mass and/or dimensions of the base (9). However, when the inventor constructed what he believed to be the best mode for practicing the instant invention, he proportioned the vertical support members such that once the device is fully assembled, the sounding element was suspended approximately 7.50 inches above the horizontal surface upon which the device was placed, the long axis of the sounding element (when a tube is used) being approximately 15.0 inches away from the upright section of the vertical support member, the sounding element further being spaced apart from the arm of the vertical support member by approximately 2.50 inches. Naturally, and in keeping with the claims, these measurements are merely provided to easily enable the practice of the invention, and may just as easily be modified to suit the particular needs of the users of the device, without departing from the disclosure, and should therefore in no way be considered as limiting the claims. Furthermore, while the accompanying drawings, which are provided merely for illustrative purposes, show the arm as being essentially linear and extending linearly outward and away from the upright section, the arm could just as easily have a number of bends or curves so as to be more decorative. So long as balance is maintained, the exact visual appearance of the base, upright section, and arm is generally unimportant.

For example, if the length of the arm (11) is increased, the sounding element may be suspended farther away from the upright section (10). However, in so doing, the center of balance of the vertical support member will be modified as well, and all other dimensions and compositions of material of the vertical support member remaining constant, the vertical support member will become more likely to tip over should the mass of the depending sounding element be increased. In such a case, the inventor has found it helpful to re-achieve stability by either increasing the dimensions of the base (9) to produce greater surface area contact between the base and the surface upon which the vertical support member is placed (e.g., the table), and/or increase the mass of the base. In another alternative for increasing stability, one could just as easily attach the upright section to the base such that the upright section was not centered on the base, but instead was offset such that the base extended further in the same direction as does the arm. The inventor believes that this tends to counter act the effects of lengthening the arm, and generally restores stability.

Again, as with the precise dimensions and material composition of the sounding element, the precise dimensions and material composition of the vertical support member may be easily modified without departing from the disclosure and claims herein. So long as the vertical support member is sufficiently stable when the device is completely assembled such that it does not accidentally fall over or tip over during use, the precise dimensions and material composition of the vertical support member are a matter of choice.

It was also noted that the simultaneous toasting device may be useful in situations other than those in which people are seated about a table. For example, at a social gathering where the participants are generally standing or walking about, it may be beneficial to have available a simultaneous toasting device which is configured for use when standing.

This may be easily accomplished by fabricating a vertical support member having an extended upright section for use with a base in contact with the horizontal surface upon which the toasters are standing. In such a case, one might fabricate the upright section such that it has a length of 3 to 5 feet, thus elevating the sounding element sufficiently above the floor so that toasters gathered around the device could simply reach out their beverage containers and simultaneously strike the sounding element. Obviously, the precise length of the upright section may be varied according to needs of the participants without departing from the disclosure and claims herein.

Whether the device is to be used in a "free standing" configuration, or on a horizontal surface such as a table, it is generally preferred that the sounding element be approximately horizontally disposed. That is, when a hollow tube, for example, is used as the sounding element, the long axis of the tube (as opposed to a radial axis) should generally lie in a horizontal plane which is parallel to, though not co-planar with, the horizontal surface upon which the fully assembled device is to be placed. The inventor believes that a sounding element whose long axis is located in a horizontal plane (parallel to the horizontal surface upon which the device is to be located) can achieve the desired goals and objectives stated above, and that orienting the sounding element such that its long axis is generally perpendicular to the horizontal surface upon which the device is to be located, would tend to be far more difficult to use by those gathered around the device. One of the purposes of the instant invention is to put the simultaneous toasting device within easy reach of those engaging in a toast, and a generally vertically oriented sounding element would be more useful only if the participants were located at different elevations from one another.

It has also been noted that the device may be constructed such that the vertical support members could incorporate decorative or useful features which would encourage their use separate and apart from the sounding element, when the complete device was not in use.

An example of such a use would be the attachment of a "socket" or other receptacle sized and shaped for firmly holding a taper or candle. Such a candle holder could be firmly or removably attached to the upright section or the arm so that the vertical support would function as an attractive candle holder when the fully assembled device was not required, thus negating any reason for removing the vertical supports when not in use as a simultaneous toasting device. One can just as easily imagine constructing the vertical support member such that the upright section was essentially hollow, and could accommodate therein a quantity of liquid, and into which fresh flowers having stems could be placed. The vertical support member would then effectively function as a vase, and once again find a place on a table when the fully assembled device was not in use.

Finally, the element connecting the vertical support member to the element has been described to be suspension means (4). The suspension means in the preferred embodiment is simply a filament having sufficient strength to support the sounding element. The suspension means is further preferred to be somewhat flexible so that when the sounding element is struck by the beverage containers, at the end of the toast, the sounding element will be able to move somewhat rather than be rigidly connected to the vertical support member.

This preferably non-rigid connection of the sounding element to the vertical support member may be most easily accomplished by using a filament such as nylon monofilament line (fishing line), string, thread, thin gauge wire or other similar filaments. Naturally, as other materials become available which could serve as substitutions for any of the aforementioned filamentous materials, those could be used just as easily.

Attachment of the preferred embodiment of the suspension means to the vertical support member may be very easily accomplished by providing a loop on the suspension means, and threading the arm through the loop so that the suspension means dangles from the arm. Another loop may be provided for on the suspension means, the loop being sized for the insertion therethrough of the sounding element such that the sounding element depends downwardly from the arm of the vertical support member, the portion of the suspension means which is not engaging the sounding element or the arm being oriented generally radially relative to the axis of the sounding element.

Obviously, while the inventor believes the simplest manner of attaching the suspension means to the sounding element and the vertical support means is via a pair of loops, one could just as easily, for example, drill or otherwise fabricate a hole having a passage through the tube wall, pass a portion of the suspension means through the hole, and fasten the suspension means within the hollow interior of the sounding element (that is, when a hollow sounding element is being used). The suspension means could then be clipped, tied, or even attached to the arm in the same manner. For example, one could drill or otherwise fabricate a hole having a passage through the arm, and pass a portion of the suspension means through the hole and secure it so that it could not re-pass through the hole once the weight of the sounding element was applied to it.

Furthermore, while the inventor prefers a flexible (non-rigid) connection between the sounding element and the vertical support member, it is entirely acceptable to instead incorporate a rigid suspension means which would tend to render the sounding element more static when struck during a toast. This may be a more preferable suspension means when a larger and or more massive sounding element is incorporated in the device, and or where one chooses to utilize a single vertical support member.

For example, if one chose to fabricate the instant invention for use by toasters who are standing, rather than gathered seated around a table, one might desire a longer sounding element, and only a single vertical support member. In such a case, the sounding element will tend to be more unstable, and behave in much the same way as would a balance scale, tipping side to side with the vertical support member serving as the fulcrum.

In such a configuration, it is believed that it may be more useful to utilize a more rigid suspension means to which the sounding element could be rigidly attached. Those familiar with the art should have no difficulty whatsoever constructing a simple suspension means, such as bracket sized and shaped for accepting and firmly holding the sounding element, the bracket further being adapted for attaching to the arm of the vertical support member. Such attachment could easily be accomplished using tapped and threaded holes in the arm and matching holes through the bracket through which fasteners such as screws or bolts could pass and threadably engage the threaded holes in the arm. Clearly, so long as the sounding element is suspended from the vertical support means, the particular means for so doing is a mere design choice, and well within the disclosure and claims which follow.

As per FIG. 1, use of the instant invention may now be easily understood. The vertical support member (3) is placed upon a generally horizontal surface, such as a table (5). The suspension means (4) is attached to the arm (11) of the vertical support member (3) such that it depends downwardly from the arm. The sounding element (2) is then attached to the suspension means (4) such that the sounding element is suspended above the generally horizontal surface, and is not in contact with the upright section (10) of the vertical support member.

The instant invention is now ready for use by those wishing to engage in a simultaneous toast. At the end of the verbal portion of the toast, those arranged around the table may now extend their beverage containers, and in unison, touch them to the sounding element such that an auditorily pleasing tone is emitted from the sounding element, and the beverage containers as well. As each person has indirectly touched each other's beverage container, by directly touching the sounding element, it is no longer required to get up and move about the table in order to touch beverage containers, and each participant has the social benefit of the simultaneous toast and the memorable experience of a group toast.

I claim:

1. A simultaneous toasting device comprising;

A. a pair of separate vertical support members,

I. the vertical support members each having an arm, a. the arm extending horizontally outwardly, away from the vertical support member, II. the vertical support members being oriented such that the arms extend toward one another, B. a pair of suspension means, I. one suspension means being removably attached to, and depending downwardly from, each arm, C. a sounding element, I. the sounding element being removably attached to the vertical support members via the suspension means, II. the sounding element having a long axis, the long axis being generally horizontal, III. the sound element extending between the vertical support members such that each of the arms extends towards the sounding element and such that each of the arms are perpendicular to the long axis of the sounding elemet.

IV. the suspension means attached at a location spaced apart from the end of the sounding element.

2. A simultaneous toasting device according to claim 1, the vertical support members each further comprising;

A. a base,

B. an upright section,

I. the upright section being attached to the base, and extending upwardly from the base, II. the arm being attached to the upright section, III. the arm being located distally from the base.

3. A simultaneous toasting device according to claim 1, the suspension means further comprising;

A. a filament.

4. A simultaneous toasting device according to claim 1, the sounding element further comprising;

A. a hollow tube.

5. A simultaneous toasting device comprising;

A. a pair of separate vertical support members,

I. the vertical support members each having a base,

II. the vertical support members each having an upright section, a. the upright section being attached to the base, and extending upwardly away from the base, III. the vertical support members each having an arm, a. the arm being attached to the upright section, b. the arm being located distally from the base, c. the arm extending outwardly, away from the upright section, IV. the vertical support members being oriented such that the arms extend toward one another, B. a pair of suspension means, I. one suspension means being removably attached to, and depending downwardly from, each arm, C. a sounding element, I. the sounding element being removably attached to the vertical support members via the suspension means, II. the sounding element having a long axis, the long axis being generally horizontal, III. the sounding element extending between the vertical support members such that each of the arms extends towards the sounding element and such that each of the arms are perpendicular to the long axis of the sounding element.

IV. the suspension means attached at a location spaced apart from the end of the sounding element.

6. A simultaneous toasting device according to claim 5, the sounding element further comprising;

A. a hollow tube.

7. A simultaneous toasting device according to claim 5, the pair of suspension means each further comprising;

A. a filament.

8. A simultaneous toasting device according to claim 7, the filament having a first end and an opposite second end, the first end having a loop sized for insertion therethrough of the arm, the second end having a loop sized for the threading therethrough of the sounding element.

9. A simultaneous toasting device comprising;

A. at least two separate vertical support members,

I. the vertical support members each having a base,

II. the vertical support members each having an upright section, a. the upright section being attached to the base, and extending upwardly away from the base, III. the vertical support members each having an arm, a. the arm being attached to the upright section, b. the arm being located distally from the base, c. the arm extending outwardly, away from the upright section, IV. the vertical support members being oriented such that the arms extend toward one another, B. at least two suspension means, I. the suspension means being removably attached to, and depending downwardly from, each arm, C. a sounding element, I. the sounding element being removably attached to the vertical support members via the suspension means, II. the sounding element having a long axis, the long axis being generally horizontal, III. the sounding element extending between the vertical support members such that each of the arms extends towards the sounding element and such that each of the arms are perpendicular to the long axis of the sounding element.

IV. the suspension means attached at a location spaced apart from the end of the sounding element.

10. A simultaneous toasting device according to claim 9, the sounding element further comprising;

A. a hollow tube.

11. A simultaneous toasting device according to claim 9, the suspension means each further comprising;

A. a filament.

12. A simultaneous toasting device according to claim 9, the filament having a first end and an opposite second end, the first end having a loop sized for insertion therethrough of the arm, the second end having a loop sized for the threading therethrough of the sounding element.

* * * * *